United States Patent [19]

Hodska

[11] 3,967,410

[45] July 6, 1976

[54] TOY DOLL

[75] Inventor: Nicholas S. Hodska, Stratford, Conn.

[73] Assignee: Lawrence Peska Associates, Inc., New York, N.Y. ; a part interest

[22] Filed: Feb. 27, 1975

[21] Appl. No.: 553,751

[52] U.S. Cl. ..... 46/116

[51] Int. Cl.[2] ..... A63H 3/24

[58] Field of Search ..... 46/116, 117, 118, 141, 46/232; 128/284

[56] References Cited

UNITED STATES PATENTS 2,570,963 10/1951 Mesmer ..... 128/284

3,514,899 6/1970 Bonanno et al. ..... 46/232

*Primary Examiner*—Louis G. Mancene

*Assistant Examiner*—Robert F. Cutting

[57] ABSTRACT

A toy doll, comprising:

a. a doll member resembling an infant human and comprising at least one apertured protrusion disposed at the abdominal area thereof and b. a diaper element comprising a flap portion that comprises a slot therein, said slot being disposed so as to receive said protrusion when said doll member is dressed with said diaper element, whereby a retaining element can be removably disposed at the aperture of said protrusion so as to hold said diaper in position.

11 Claims, 7 Drawing Figures

TOY DOLL

BACKGROUND OF THE INVENTION

The present invention relates to a toy doll that can be dressed with a diaper.

Toy dolls are, of course, widely known and played with by small children, toy dolls that resemble an infant human being commonly played with by young girls. Such toys are desirable, inter alia, by reason of the fact that they serve to teach young girls how to care for human infants, preparing them for their future roles as mothers. The present invention has a number of advantages one of which is that the present toy doll can be used to teach young girls how to dress and care for human infants.

SUMMARY OF THE INVENTION

The present toy doll comprises a doll member that resembles an infant human and has two apertured protrusions disposed from the central axis at the abdominal area of the doll and furthermore, comprises a diaper element of uniform thickness that includes a plurality of flap portions comprising a substantially elongated slot therein. Each individual slot of the diaper element is disposed, when the diaper is placed on the infant, so as to receive the protrusions, thereby permitting retaining elements, e.g., safety pins or otherwise, to be removably disposed at the aperture of the protrusion so as to hold the diaper in place.

PREFERRED EMBODIMENT

Figure 4:
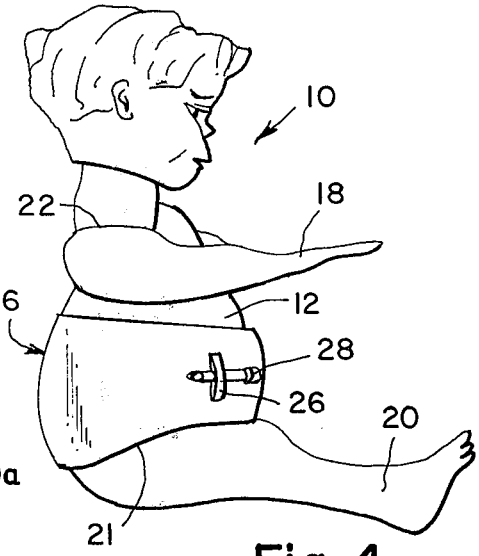
FIG. 4 is a side view of the toy doll with the present diaper element in position thereon.
Figure 5:
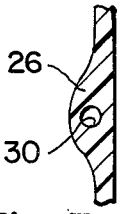
FIG. 5 is a sectional side elevation view of one of the protrusions located on the present toy doll, which protrusion is viewed in FIG. 5 along the axis 5—5 in FIG. 2.

Referring to the figures, the present toy doll 10 (FIG. 4) resembles a human infant and comprises lower torso portion 12 (FIGS. 1, 2) that includes the abdominal area 14, with the diaper element 16 disposed at the abdominal area 14. The doll 10 includes upper and lower limbs 18 and 20, respectively, that can be movable at joints 21 and 22, respectively. Adjacent each of the sides of the doll from the central axis and at the abdominal area 14 is a protrusion 26 (FIGS. 1, 2 and 4) that can accommodate a diaper pin 28 or some other suitable retaining element or fastener. It is preferred that the toy doll include two protrusions which can be lugs 26 (FIG. 5) that are equally spaced apart from the central axis at the abdominal area and inwardly a short distance from the outer edges of the doll and above the hips of the toy doll.

Figure 2:
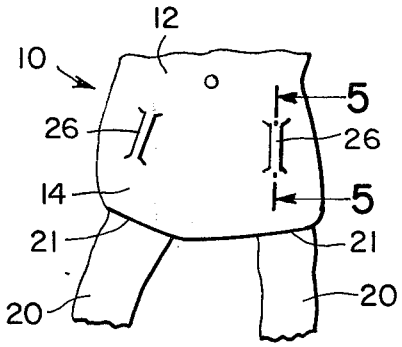
FIG. 2 is a front elevation view of the diaper of the toy doll's lower torso area without any diaper.

The lugs 26 can be apertured semi-circular, round or rectangular shapes or protrusions of other shapes and can be an integral part of the doll structure (as shown in FIG. 2) or, alternatively, the protrusions, e.g., the lugs, can be discrete parts that are attached to the toy doll. Where it is desired the hole or aperture 30 of the lugs can be chamfered, although, if it is desired, the chamfer may be omitted and only the holes 30 provided to accommodate the diaper pins 28. Alternatively the holes 30 may be elongated to facilitate the pinning of the diaper.

Figure 1:
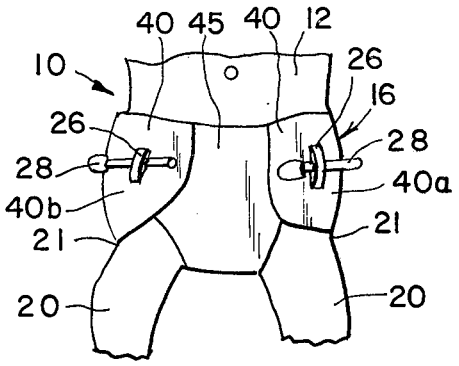
FIG. 1 is a front elevation view of the lower torso area of the present toy doll with the diaper in place thereat.
Figure 3:
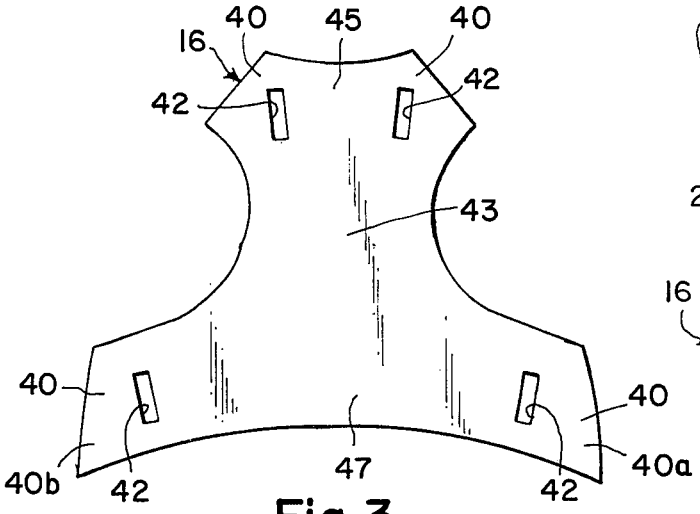
FIG. 3 is a top view of the present diaper element according to an embodiment of the present invention, which diaper element is fully expanded.
Figure 7:
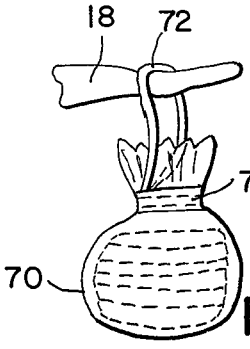
FIG. 7 is a side view of a purse that can according to another embodiment of the present invention be included with the toy doll for storing one or more diaper elements.

The diaper element 16 (FIGS. 3 and 6) comprises at least one flap portion 40 that includes a slot 42, it being preferred however, that the diaper element comprise plural, e.g., four flap portions 40 that are peripherally disposed about a central portion 43 thereof, as shown in FIG. 3, with at least one slot 42 disposed at each of the flap portions 40 such that when the upper portion 45 of the diaper element is disposed the slots 42 therein can receive and fit over the lugs 26 of the toy doll, as indicated in FIG. 1 whereby the upper portion or end part 45 is disposed at the front abdominal area of the toy doll, the lower portion or end part 47 of the diaper element 16 can then be disposed at the rear area of the lower torso of the toy doll with the flap portions **40*a* and 40*b* thereof being brought around to the front abdominal area so that the slots 42 of the flap portions 40*a*, 40*b* can receive and fit over the lugs 26. The diaper element 16 can thus be seen to be locatable on the toy doll 10 in which the same fashion that real diapers are dressed on human infants, with the narrower central portion 43 of the diaper element being disposed at the crotch of the toy doll, as indicated in FIG. 1. When the diaper is in place so that the paired flap portions are disposed at their respective lugs 26, as shown in FIG. 1, with the lugs 26 extending through and beyond the slots 40 of their associated front portions, the flap portions 40,** and therefore, the diaper can be secured to the toy doll by means of pins (i.e., safety pins) or other suitable fastening means inserted at the lug holes.

Where it is desired, a diaper bag 70 may also be provided with extra diapers, as shown in FIG. 7. The diaper bag 70 is preferably provided with drawstring 72 adapted to be placed over upper limb 18 of doll 10 after closing the neck portion 74 of bag 70.

Figure 6:
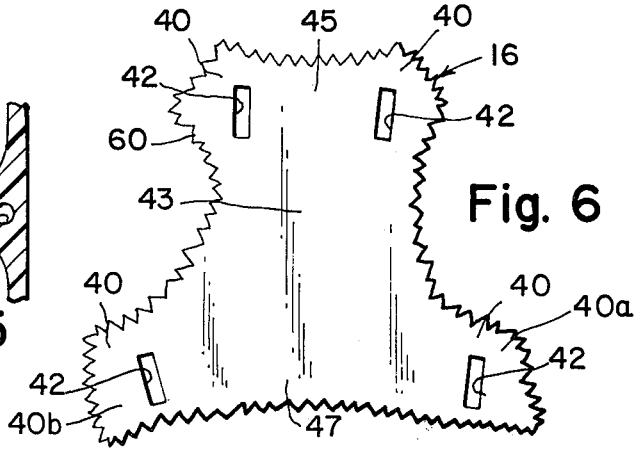
FIG. 6 is a diaper element of the present invention according to a further embodiment, which diaper element is depicted in top view with the diaper fully expanded.

The diaper may be cut with a smooth edge, as shown in FIG. 3 or (optionally) an arrangement may be provided whereby the edge 60 is scalloped or indented with saw-like edge (FIG. 6). The material of the diaper element, which (as can the doll itself) can be made, e.g., of cloth, plastic, or rubber or other type of fabric or material, is never penetrated by the pins since the slots 42 fit neatly around and receive the lugs 26. The diaper can be contoured or fitted at the base of the lugs or adjacent to the doll's body.

In removing the diaper element 16, the individual unlocks and removes the two safety pins 28 affixed at the lugs 26. The flaps 40 are moved away from the body, freeing the two slots 42 in the lower end portion 47 of the device. Then the upper end portion flaps are pulled away, permitting the upper slots 42 to fall free from the lugs 26 and the entire device is slipped from between the doll's legs 20.

It will be seen that with this device, the doll and the diaper are one compatible arrangement, the diaper may be easily and quickly and very effectively folded, with no danger of slippage or creepage from the doll's anatomy, and still the diaper can be easily and quickly pinned by means of the diaper pins. The item is an educational toy: the child learns how to apply the diaper and the safety pins by itself, per se.

Relevant hereto are U.S. Pat Nos. 2,538,845; 2,568,910; 2,570,796; 2,705,010; 3,351,062; and 3,583,093.

Having thus described the invention, what I claim as new is:

1. A toy doll, comprising:

a. a doll member resembling an infant human and comprising at least one apertured protrusion disposed at the abdominal area thereof and b. a diaper element comprising a flap portion that comprises a slot therein, said slot being disposed so as to receive said protrusion when said doll member is dressed with said diaper element, whereby a retaining element can be removably disposed at the aperture of said protrusion so as to hold said diaper in position therein said diaper element comprises an elongated central portion and respective said flap portions extending in opposite directions from said first end part, connected at opposite sides of a first end part of said central portion and said central portion comprising a second end part disposed opposite said first end part, said second end part comprising oppositely disposed said slots and each of said flap portions comprising a said slot.

2. A toy doll as in claim 1, wherein said protrusion comprises a lug element.

3. A toy doll as in claim 1, wherein said doll member comprises plural said protrusions spacedly disposed from each other at said abdominal area.

4. A toy doll as in claim 1, wherein said diaper element comprises a scalloped peripheral edge portion.

5. A toy doll as in claim 1, further comprising a purse for storing a diaper element, said purse being removably disposed on a limb of said doll member.

6. A toy doll as in claim 1, wherein said protrusion and said doll member comprise an integral structure.

7. A toy doll as in claim 1, wherein said protrusion has a configuration that is one of semi-circular, round, and rectangular.

8. A toy doll as in claim 1, wherein said protrusion is discrete from said doll member and is mounted thereon.

9. A toy doll as in claim 1, wherein said protrusion comprises a chamfered aperture.

10. A toy doll as in claim 1, wherein said flap portions extend substantially normal to said first end part.

11. A toy doll as in claim 1, wherein said diaper element comprises a smooth edge portion.

* * * * *